United States Patent [19]

Meyers et al.

[11] 4,352,422

[45] Oct. 5, 1982

[54] BOX TRANSFER APPARATUS

[75] Inventors: George L. Meyers, Menasha; Thomas M. Gorshe, Neenah, both of Wis.

[73] Assignee: American Can Company, Greenwich, Conn.

[21] Appl. No.: 191,342

[22] Filed: Sep. 26, 1980

Related U.S. Application Data

[60] Continuation of Ser. No. 29,685, Apr. 13, 1979, abandoned, which is a division of Ser. No. 845,224, Oct. 25, 1977, Pat. No. 4,164,171.

[51] Int. Cl.[3] ..... B65G 47/24

[52] U.S. Cl. ..... 198/404; 198/408; 198/480

[58] Field of Search ..... 198/404, 408, 480; 414/761-763, 772; 493/163, 183

[56] References Cited

U.S. PATENT DOCUMENTS

| | | | |
|---|---|---|---|
| 1,861,567 | 6/1932 | Henry | 53/585 |
| 3,235,060 | 2/1966 | Gamberini | 198/404 X |
| 3,656,417 | 4/1972 | Scully | 93/52 |
| 4,064,016 | 12/1977 | Vortmann | 198/412 |

FOREIGN PATENT DOCUMENTS

| | | | |
|---|---|---|---|
| 1191736 | 4/1965 | Fed. Rep. of Germany | 198/480 |
| 920146 | 3/1963 | United Kingdom | 53/563 |

*Primary Examiner*—Jeffrey V. Nase

*Attorney, Agent, or Firm*—Kinzer, Plyer, Dorn & McEachran

[57] ABSTRACT

Apparatus for rotationally transferring the set-up carton shells to carton filling and closing apparatus. Means is provided at a suitable one of the stations for applying adhesive to side flap portions of the folded blanks to retain their set-up modes as tubular carton shells.

1 Claim, 5 Drawing Figures

STATION 1
STATION 2
STATION 3
STATION 4

BOX TRANSFER APPARATUS

This is a continuation of application Ser. No. 029,685, filed Apr. 13, 1979, now abandoned, which in turn was a division of application Ser. No. 845,224, filed Oct. 25, 1977, now U.S. Pat. No. 4,164,171.

This invention relates to packaging, and more particularly to improvements in apparatus for forming tubular carton shells from single blanks of paperboard or the like.

It is a general objective of the present invention to provide improved carton shell forming apparatus that is economical both in its structure and in its operation.

It is another objective of the invention to provide improved carton shell forming apparatus that is readily adaptable for use in combination with carton filling apparatus of known type.

It is a further objective of the invention to provide improved carton shell forming apparatus that is versatile, both in its structure and in its adaptability for use in combination with other carton handling apparatus.

A still further objective of the invention is to provide improved transfer apparatus for carton shells or like articles operative to remove carton shells from a forming machine and to rotationally orient same for presentation to further shell handling apparatus, such as, for example, a carton filling machine.

The manner in which the foregoing as well as other objectives and advantages of the invention may best be achieved will be more fully understood from a consideration of the following description, taken in light of the accompanying drawing.

DESCRIPTION OF THE PREFERRED EMBODIMENT

Figures 1, 2, 3:
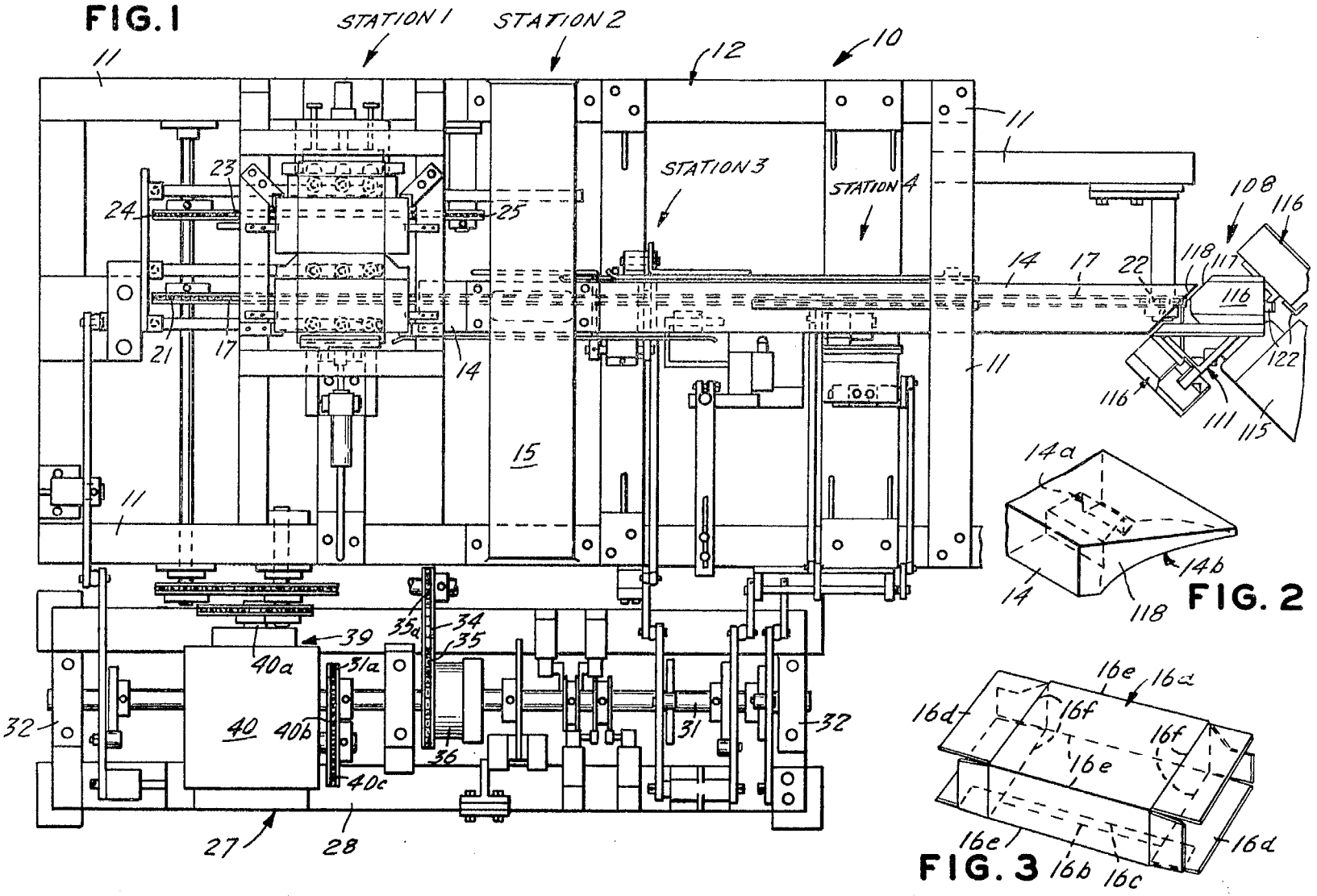
FIG. 1 is a top plan view of carton shell forming apparatus embodying the invention, and prior to initiating its operation.
FIG. 2 is a fragmentary perspective showing a right hand portion of the apparatus seen in FIG. 1.
FIG. 3 is a perspective view of one form of carton shell made by apparatus embodying the invention.

With more detailed reference to the drawing, and first to FIG. 1, carton shell forming apparatus 10 comprises frame structure 11 including a horizontally extending platform section 12. A carton shell forming mandrel 14 extends horizontally along platform section 12 and is fixedly supported on the latter by bracket means 15. As will be appreciated more fully from what follows, bracket means 15 is so constructed and arranged as to afford sufficient vertical clearance for a carton blank as it is folded upwardly onto mandrel 14, as it is moved therealong, for subsequent sequential folding and gluing into a carton shell **16*a* as seen in FIG. 3, including side glue flaps 16*b*, 16*c*, and end closure flaps designated generally by the numeral 16*d*. The glue flaps are affixed to the carton panel portions, and panel portions to one another by longitudinally extending scored fold lines 16*e*. The closure flaps are attached to the panel portions by transversely extending scored fold lines 16*f***.

A carton blank feed or conveyor apparatus for moving the blank along the mandrel includes an intermittently driven chain 17 extending lengthwise of platform section 12 beneath mandrel 14. Chain 17 is a standard roller chain supported on sprockets 21 and 22, and is provided with carton blank pusher lugs so spaced along the chain as to be disposed at either end of a carton blank as it is driven along the mandrel.

The apparatus further includes a shorter chain 23 disposed about sprockets 24 and 25 on platform 12, so that it is parallel with chain 17, and is provided with lugs 26 that cooperate with lugs 18 to maintain blank 16 square to the mandrel 14 as it is moved therealong in earlier stages of its folding sequence. In the operation of chains 17 and 23, and as will be more fully described in what follows, sprockets 21 and 24 serve as the respective drive sprockets and sprockets 22 and 25 serve as the respective idler sprockets. It will be also noted that sprocket 22 is located at the "downstream" end of mandrel 14, and sprocket 25 is located in the region of the "upstream" end of the mandrel. Thus, the conveyor chains 17 and 23 are coextensive, in mutually spaced relation for feeding a flattened blank to the mandrel, and chain 17 and lugs 18 thereafter conveys the blank along the mandrel. Thus, the coextensive sections of chains 17 and 23 form a first conveyor section, whereas the extended portion of chain 17 forms a second conveyor section.

Still with reference to FIG. 1, a drive assembly designated generally by the numeral 27 comprises a frame portion 28 disposed laterally of, and at a lower level than, platform section 12 of frame structure 11. A camshaft 31 is rotationally supported in pillow blocks 32 provided on frame portion 28 and prime mover means (not shown) is drivingly coupled with camshaft 31 through a roller chain 34 disposed about a sprocket **35*a* on a shaft S of the prime mover means and a sprocket 35 on a clutch 36 coupled to the camshaft. Clutch 36 is of the air-operated, single position type affording on-off drive of camshaft 31 according to operation of the prime mover which conveniently may be the drive means for a carton filling machine (not shown) with which the carton shell forming apparatus 10 is associated. An indexing drive assembly 39 is operative to convert the continuous rotary motion of camshaft 31 to an intermittent rotary drive for conveyor chains 17 and 23**.

Indexing drive assembly 39 includes an indexing box 40 of commercially available type, being a four stop, 90° output rotation box with a 120° index time and a 240° dwell time on the timing of its output shaft **40*a*. Indexing box 40 is driven by a roller chain 40*b* that extends over camshaft sprocket 31*a* and box input shaft sprocket 40*c*. Sprockets 31*a* and 40*c*** are of identical diameters, affording a one-to-one drive ratio.

The several carton shell forming and folding stations and their related mechanisms are identified as follows:

Station 1: Carton Blank Drawdown Mechanism
Station 2: Carton Initial Folding Mechanism
Station 3: Carton Secondary Folding Mechanism
Station 4: Carton Final Folding Mechanism.

Figure 4:
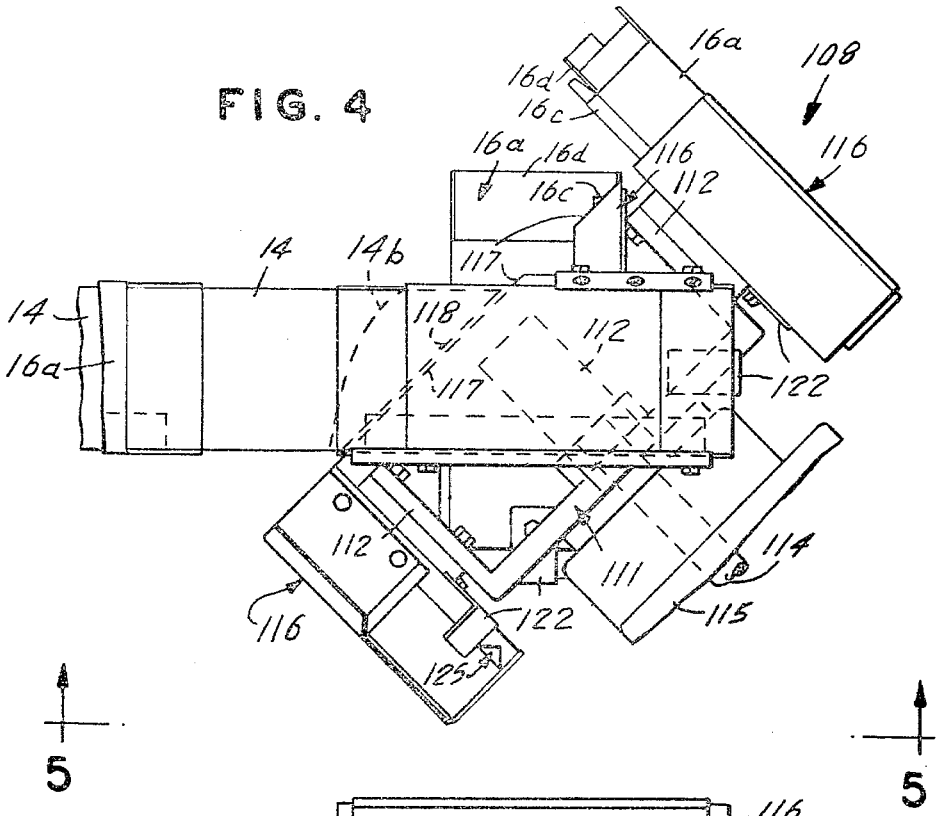
FIG. 4 is an enlarged fragmentary view of the right-hand portion of the apparatus shown in FIG. 1.
Figure 5:
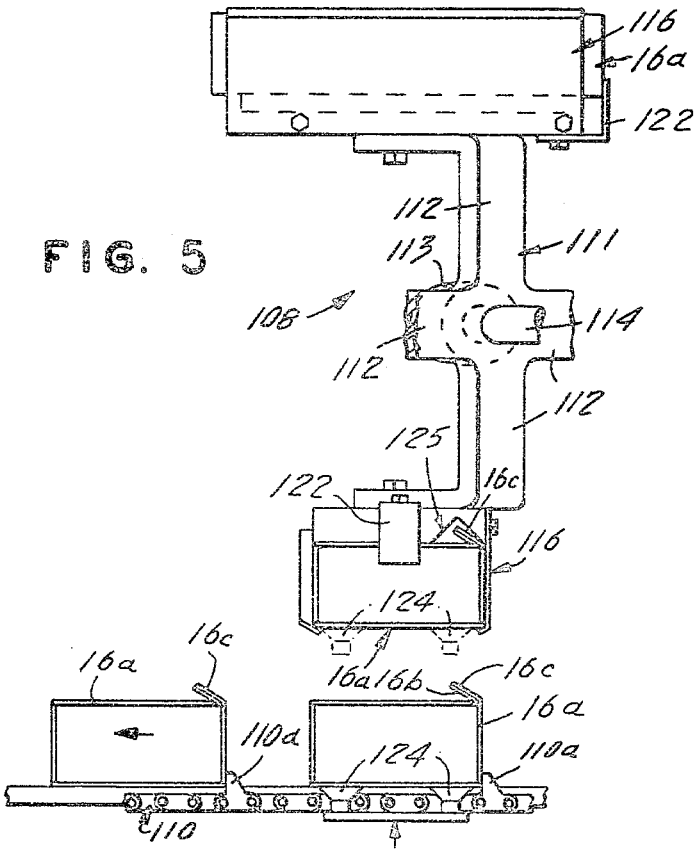
FIG. 5 is a elevational view of apparatus shown in FIG. 4, as seen looking in the direction of arrows 5—5 applied thereto.

With reference again to FIG. 1, and also to FIGS. 4 and 5, transfer means for receiving and transporting open ended shells **16*a* as they are discharged from the downstream end portion of mandrel 14, to suitable conveyor means, is designated generally by the numeral 108. Conveyor means for transporting carton shells 16a to a suitable filling machine (not shown) is designated generally by the numeral 110 (FIG. 5). By way of example, conveyor means 110 may take the form of a double chain provided with lugs 110a, disposed below, and extending generally parallel to mandrel 14**.

The means 108 for transferring carton shells 16a from mandrel 14 to conveyor 110 comprises wheel means 111 provided with four arms or spokes 112 of equal length, spaced 90° apart, and rotatable on a hub 113 affixed to the shaft 114 of a conventional indexing apparatus 115 mounted on suitable frame structure. Shaft 114 is so positioned that its axis is below and extends with angularity, for example at an angle of 45°, as respects the line of extension of mandrel 14.

The end of each arm 112 supports a carton shell receiving pocket or carrier 116 disposed in alignment with the line of extent of mandrel 14, so that each pocket extends at an angle of 45° as respects the rotational plane of wheel means 111 about its axis as defined by shaft 114. Thus the sum of the aforesaid shaft and pocket angles is 90°, or the angle through which the carton shell is turned about its transverse axis upon rotation of wheel means 111 through an angle of 180° to transfer a carton shell 16a from mandrel 14 to conveyor 110. Indexing apparatus 115 is operable to rotate wheel means 111 through an angle of 90° per indexing increment, affording a suitable dwell period for positioning a pocket 116 in alignment with mandrel 14 in order to receive a carton shell 16a.

Each pocket 116 is of generally U-shaped cross-section and its interior surface is slightly larger than the outer surface of a carton shell 16a to accommodate ease of sliding of the carton shell into and out of the pocket. Each sidewall pocket 116 also is angled along its extremity toward the one opposite, in order to aid in retention of a shell.

The end of mandrel 14 is formed at a 45° angle as seen at 118 in FIGS. 1, 4 and 5, and is disposed for matching alignment with the end pocket 116 formed also at a 45° angle, as seen at 117 in FIGS. 1 and 4. By virtue of the fact that these two 45° angles match or mate, as will be evident from the drawing, each carton shell will undergo a smooth, axial movement from the discharge end of the mandrel directly to the pocket 116 aligned to the axis of the mandrel; moreover, needed space may be saved, or utilized, since the matching 45° angles enable the wheel 111 and associated pockets 116 to be neatly and compactly related to the discharge end of the mandrel while nonetheless performing the task of inverting the carton shell about its longitudinal axis and rotating or turning the shell 90° in the horizontal direction. The opposite end of pocket 116 is provided with an abutment 122 disposed and adapted to engage and establish the position of a shell 16a in the pocket. A V-shaped groove 125 extends the length of the bottom of pocket 116 and receives the slightly projecting flaps 16b, 16c of the formed shell. A curved surface 14b is provided on the underside of the end portion of mandrel 14 to ensure clearance of the end flaps 16d therewith as a carton shell is rotationally withdrawn from the mandrel by transfer wheel 108.

In operation of the transfer means 108, and with reference to FIGS. 1, 4 and 5, in which wheel means 111 is in an indexed position, a carton shell is moved from mandrel 14 into pocket 116. The wheel means is then moved incrementally to its next indexed position to present a pocket 116 and carton shell 16a for alignment with lugs 110a on conveyor 110. In moving from mandrel 14 to wheel means 111, a carton is turned, simultaneously, through an angle of 90° about its transverse axis and through an angle of 180° about its longitudinal axis.

A pair of suction cups 124 are disposed and adapted for extension to a carton shell engaging position in the lower, oriented position thereof, and retraction to a carton shell removing position, whereupon a removed carton shell 16a is drawn down onto conveyor means 110 associated with the carton filling apparatus (not shown) and operative to move the transferred carton shells in the direction of the applied arrow.

While the disclosed carton shell 16a formed by apparatus embodying the invention is for a carton of the so-called flip-top type, it will be appreciated that other carton shells can be fabricated for other cartons such as, for example, cartons of the end-opening type. The presently disclosed carton shell is, of course, typical of a kind not readily adapted for flattening after or during the gluing process. Accordingly, it will be appreciated that the capability of producing set-up carton shells is an important advantage of the invention.

While the invention has been described with reference to a preferred embodiment, it will be apparent to those skilled in the art that various changes and modifications can be made without departing from the scope of the appended claims.

We claim:

1. Transfer means for transferring flat-sided boxes between a pair of first and second conveyors disposed in different horizontal planes, the first of the conveyors moving a box in the process of being folded along a folding mandrel toward a discharge end of the mandrel and the second conveyor receiving the folded box discharged from the mandrel for transporting the received box to a filling machine, the second conveyor extending along a different path beneath the first conveyor, and comprising:

a plurality of mutually spaced box carriers supported by arms attached to a horizontal shaft for rotational movement about an axis disposed between said planes at the end of the conveyor associated with the mandrel which axis extends at a first 45° angle as respects the horizontal axis of the direction of travel of the first conveyor in its horizontal plane of travel, said carriers being disposed at a second 45° angle as respects the rotational plane of movement of said arms about said axis so that when said shaft is rotated 360° the axis of each carrier is sequentially aligned first to the axis of said first conveyor and 180° later is at right angles to the axis of the first conveyor, an indexing means for effecting incremental movement of said first conveyor and like incremental movement of said box carriers about said axis of said horizontal shaft in unison to accommodate feed of said boxes from the discharge end of said mandrel individually to related ones of said container carriers for transfer individually to the second of said conveyors, thereby to invert and turn said boxes 180° about their longitudinal axes and 90° about their transverse axes, respectively, with respect to said first conveyor;

each carrier being pocket-shaped in cross section and presentable to the discharge end of said mandrel laterally to receive and to hold a box in provision of its transposition and transfer between said conveyors, each said carrier being presentable in juxtaposed relation to and above said other conveyor to discharge a box radially from a related carrier to said other conveyor, and means effective at the time of juxtaposition to transfer a box from each said carrier to said other conveyor upon completion of inverting the box 180° and turning said box through said 90° angle;

the discharge end of said mandrel being defined by a 45° angle when viewed in top plan and the end adjacent thereto of each carrier being defined by a mating 45° angle so the horizontal axis of each pocket is substantially coincident to the horizontal axis of the mandrel each time a 45° end of a pocket is mated to the 45° end of the mandrel.

* * * * *